US006579441B1

(12) United States Patent
Biscardi et al.

(10) Patent No.: US 6,579,441 B1
(45) Date of Patent: Jun. 17, 2003

(54) HAZE-FREE LUBRICATING OILS

(75) Inventors: Joseph A. Biscardi, Berkeley, CA (US); Darren P. Fong, Oakland, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 538 days.

(21) Appl. No.: 09/590,439

(22) Filed: Jun. 9, 2000

Related U.S. Application Data

(63) Continuation-in-part of application No. 09/483,305, filed on Jan. 14, 2000, now Pat. No. 6,468,417, and a continuation-in-part of application No. 09/330,339, filed on Jun. 11, 1999, now abandoned.

(51) Int. Cl.[7] ..... C10G 71/00; C10G 73/38; C10M 101/02

(52) U.S. Cl. ..... 208/18; 208/28; 208/299

(58) Field of Search ..... 208/18, 28, 299, 208/950

(56) References Cited

U.S. PATENT DOCUMENTS

| | | | | |
|---|---|---|---|---|
| 3,576,735 A | | 4/1971 | Murphy et al. | 208/27 |
| 4,367,364 A | | 1/1983 | Kulprathipanja et al. | 585/826 |
| 4,474,618 A | | 10/1984 | Yen et al. | 208/111 |
| 4,810,355 A | * | 3/1989 | Hopkins | 208/58 |
| 4,867,862 A | | 9/1989 | Ziemer | 208/27 |
| 4,950,382 A | | 8/1990 | Yao et al. | 208/28 |
| 4,982,052 A | | 1/1991 | Nolte | 585/822 |
| 5,466,364 A | | 11/1995 | Kaul et al. | 208/307 |
| 5,525,312 A | | 6/1996 | Ramos, Jr. | 422/211 |
| 5,554,307 A | | 9/1996 | Dagorn et al. | 508/111 |
| 5,614,079 A | | 3/1997 | Farnos et al. | 208/27 |
| 6,051,129 A | * | 4/2000 | Harris et al. | 208/138 |
| 6,468,418 B1 | * | 10/2002 | Biscardi et al. | 208/299 |

* cited by examiner

*Primary Examiner*—Bekir L. Yildirim
(74) *Attorney, Agent, or Firm*—Penny L. Prater; Alan W. Klaassen

(57) ABSTRACT

A base oil feed having a tendency to form a haze at ambient or sub-ambient temperatures is contacted with a solid adsorbent to remove at least a portion of the haze precursors, thereby reducing the haze-forming tendency of the base oil feed.

16 Claims, 4 Drawing Sheets

HAZE-FREE LUBRICATING OILS

This application is a continuation-in-part application of copending U.S. Ser. No. 09/330,339, filed Jun. 11, 1999, abandoned the entire disclosure of which is incorporated herein by reference for all purposes. This application is also a continuation-in-part application of copending U.S. Ser. No. 09/483,305, filed Jan. 14, 2000 now U.S. Pat. No. 6,468,417B1 the entire disclosure of which is incorporated herein by reference for all purposes

FIELD OF THE INVENTION

This invention is directed to a haze free lubricating oil base stock.

BACKGROUND OF THE INVENTION

The present invention relates to a lubricating oil base stock and to a sorption process for dehazing a base oil feed to produce the lubricating oil base stock. Lube base oils are normally prepared from crude oil distillates and residua or synthetic oils using a series of upgrading steps, which may include hydrocracking or solvent extraction to remove heteroatoms and aromatics and to increase the viscosity index of the base oil; dewaxing to remove wax; and a finishing step for stabilizing the product against oxidation and floc and color formation.

API Interchange Guidelines (API Publication 1509) defines a Group II base oil as having ≦300 ppm sulfur, ≧90% saturates and a viscosity index of 80–120. A Group III base oil is defined as having ≦300 ppm sulfur, ≧90% saturates and a viscosity index of ≧120. Group II base oils are typically made using hydroprocessing (hydrocracking or severe hydrotreating) to increase the VI of the crude to the specification value. Hydroprocessing also typically increases the saturate content above 90% and reduces the sulfur below 300 ppm. Approximately 10% of the lube base oil production in the world is in the Group II category. About 30% of U.S. production is Group II. Group III base oils are typically made using wax isomerization technology to make very high VI products. Since the starting feed is waxy VGO or wax which contains mainly saturates and little sulfur, the Group III products have saturate contents above 90% and sulfur contents below 300 ppm. Fischer Tropsch wax is an ideal feed for a wax isomerization process to make Group III lubes. Only a small fraction of the world's lube supply is in the Group III category.

Conventional methods for removing wax from a base oil feed include solvent dewaxing and catalytic dewaxing. The degree of dewaxing during one of these dewaxing processes is generally determined by the desired product pour point, where the pour point is a measurement, expressed as a temperature, at which the sample will begin to flow under carefully controlled conditions. Pour point may be determined by, for example, ASTM D5950-96. The cloud point of a lube base oil is complementary to the pour point, and is expressed as a temperature at which a lube oil sample begins to develop a haze under carefully specified conditions. Cloud point may be determined by, for example, ASTM D5773-95. Generally, both the pour point and the cloud point are decreased during dewaxing.

Typical lube base oils will have pour points below +10° F. (−12° C.) and cloud points below +14° F. (−10° C.). These specifications are satisfactory for the majority of lube base oils used in engine lubrication. For a few small volume applications intended for cold climates, lower pour and/or cloud points may be needed. The pour point, may be reduced by adding chemical pour point depressants, but these chemical additives are expensive.

Solvent dewaxing is the traditional method, but suffers from the need to use expensive solvents which also contribute to air and water emissions. Solvent dewaxing has the additional disadvantage in that it produces slack wax, which generally has low value. Catalytic dewaxing is the more recent technology and eliminates the needs for solvents. In general it is observed that oils produced by solvent dewaxing will have pour and cloud points that are not significantly different. That is, the pour-cloud spread (the absolute value of their differences) will be less than or equal to 5° C. For example, U.S. Pat. No. 4,950,382 shows typical data from solvent dewaxing that does not exceed 5° C. When lube base oils are produced by catalytic dewaxing, however, the pour-cloud spreads can be higher than 5° C. As lube base oils become highly paraffinic, the pour-cloud spread tends to increase. For example U.S. Pat. No. 5,015,361 describes the preparation of a lube base oil by oligomerization of propylene in two stages. The lube base oil has a 50° C. pour-cloud spread.

Some base oil feeds, particularly heavy streams such as bright stock, contain naturally-occurring haze precursors that are more difficult to remove by conventional dewaxing than are the paraffinic waxes which predominate in lower boiling waxy streams. If present in sufficient quantities, the haze precursors form a haze in the base oil at ambient (or lower) temperatures, particularly if the base oil is allowed to stand at the low temperature for some time, e.g. overnight. The base oil may develop a hazy appearance even after being dewaxed to a low pour point, e.g. less than −5° C. Conversely, the haze generally disappears when the base oil is heated slightly, e.g. to a temperature of 80° F. or above. The haze will generally be the color of the base oil in which it forms, and is usually white when present in otherwise colorless oil. Haze precursors which give rise to the hazy appearance have significant paraffinic character, some with cyclic components having a long paraffin-like tail. As such, these haze precursors are expected to have substantially different molecular structures than do the color bodies and heteroatom molecules removed by conventional clay filtering for oil stabilization. The presence or absence of a visual haze may be determined using the clear-and-bright standard of ASTM D-4176-93 (Reapproved 1997). The haze may also be quantified by measure of clarity. Haze and turbidity are less well connected with a functional problem of the lube base oil and more associated with general customer acceptance. Customers prefer to use lube base oils that have no haze or turbidity and are "Bright and Clear" on observation. Haze and turbidity can be present in a lube sample at temperatures in excess of the cloud point. Haze and turbidity is often associated with water, foreign solid material, and/or traces of wax-like hydrocarbons. For the subject of this invention, the cause of the haze is not associated with water or solids as these are assumed to be removed by other processing steps. The subject of this invention relates to haze and turbidity induced by traces of wax-like hydrocarbons.

While haze and turbidity are not functional problems, their importance has been recognized in the prior art. For example U.S. Pat. Nos. 4,702,817 and 4,820,400 describe the removal of haze from a lube base oil solvent mixture by electrophoresis during solvent dewaxing. In U.S. Pat. No. 4,820,400, visual inspection is used to measure the haze in the lube base oil. U.S. Pat. No. 4,627,901 describes a light-scattering turbidity measuring device for control of the electrophoresis de-hazing process.

U.S. Pat. Nos. 4,919,788, 5,110,445 and 5,302,279 mention the formation of haze when a petroleum based catalytically dewaxed oil is stored overnight. This haze is referred to as the Overnight Cloud, and is measured by D2500. These patents also describe how catalytically dewaxed lube base oils typically have higher pour-cloud spreads than solvent dewaxed lube base oils. U.S. Pat. No. 5,614,079 also confirms the higher pour-cloud spreads from catalytically dewaxed lubes and mentions the use of a relative turbidity measuring device as part of D2500.

U.S. Pat. Nos. 4,822,476 and 4,867,862 describe the use of a commercial device for quantifying the turbidity of lube base oils. In these patents, the measurement of the turbidity device is expressed as nephelometric turbidity units (NTU), and a maximum value of 24 is specified. In this test, the oil is dissolved in Methyl-Ethyl-Ketone (MEK), the wax recovered, and then redispersed in MEK where the NTU value is measured by a Hach Model 18900 ratio turbidimeter.

There are several examples in the literature that have lube base oils with satisfactory pour points (below −12° C.) but with unsatisfactory cloud points (above −10° C.). See for example U.S. Pat. Nos. 6,051,129, 5,413,695, 5,376,260, 5,135,638, 5,741,751, and 5,514,362. Use of catalytic dewaxing to remove the last traces of cloud, haze and turbidity is possible, but with typically a substantial loss in yield. Since cloud, haze and turbidity are predominantly non-functional specifications and associated with customer acceptance, the desired solution is one that affects the customer's visual observation directly: haze and turbidity rather than cloud point. Thus what is desired is a lube base oil that has acceptable turbidity (below 2.0 NTU and preferably below 1.0) but can have relatively high cloud points (−10° C. to +20° C.). If a lube base oil has a cloud point above +20° C., it will not have an acceptable turbidity. Furthermore, what is desired is an acceptable lube base oil made from a previously catalytically dewaxed lube base oil that initially had an acceptable pour point, and unacceptable cloud point, and an unacceptable turbidity. This acceptable lube base oil should be made by a process other than further catalytic dewaxing (which causes unacceptable yield losses) and not solvent dewaxing (which involves the use of expensive and environmentally undesirable solvents).

SUMMARY OF THE INVENTION

The present invention is directed to a lubricating oil base stock having a reduced tendency to form a haze after standing at ambient temperatures process, the base stock characterized by a pour point of less than −5° C., a cloud point greater than 0° C., preferably greater than 5° C. and an NTU value of less than 2.0. A preferred lubricating oil base stock has a viscosity of greater than 6.5 cSt (measured at 100° C.), and boils in the range 650–750° F.+, preferably in the range 750–850° F.+. Neutral oils of the invention will generally boil at temperatures below about 1050° F. Bright stock oils may boil at temperatures up to 1300° F. and higher. The present invention is also directed to a lubricating oil base stock having a cloud point greater than 0° C. and an NTU value of less than 2.0, the base stock being prepared by the method comprising contacting a 650–750° F.+paraffinic stream derived from a Fischer-Tropsch process with a dewaxing catalyst at a temperature in the range 500–800° F. and a pressure in the range 100–3000 psig and producing a dewaxed oil having a pour point of less than −5° C., a cloud point greater than 0° C. and an NTU value of greater than 2.0 and contacting at least a portion of the dewaxed oil with a solid sorbent and producing the lubricating oil base stock.

The present invention is also directed to a process for removing a substantial portion of the haze precursors from a base oil feed, and more specifically from a dewaxed base oil feed, with little or no reduction in lube stock yield. Accordingly, the present invention provides a lubricating oil base stock and a process for producing an improved base stock with a reduced tendency to form a haze after standing at ambient temperatures, the process comprising contacting a base oil feed with a solid sorbent for a time and at conditions sufficient to produce a dehazed base oil having a reduced cloud point relative to that of the base oil feed.

Unlike conventional dewaxing processes, the present sorption process reduces the cloud point of the base oil feed with little or no effect on the yield of lube base oil. The yield of lube base oil based on the weight of base oil feed to the sorbent bed is greater than about 95%, and preferably greater than about 98%. Yields of up to 100% can be expected in some cases during steady state operation. A base oil feed which is a preferred feedstock for the present process has a low pour point, typically less than −5° C., though the pour point may be as low as −40° C. and lower, and a pour-cloud spread of 10° C. or more, and preferably 15° C. or more. The cloud point of the feedstock is above −5° C., generally above 0° C., and may be as high as 30° C. or higher. In the process, the cloud point of the dehazed base oil is reduced relative to the base oil feed to the process. Preferably, the cloud point of the dehazed product from the process is less than 15° C., and more preferably less than 10° C.

Preferred adsorption condition for removing the haze includes a temperature in the range of 15° C. (60° F.) and 60° C. (140° F.), and a flow rate of hazy oil of between 0.01 $hr^{-1}$ and 10 $hr^{-1}$.

Further to the invention is a process for producing an improved base oil with a reduced tendency to form a haze after standing at ambient temperatures, the process comprising contacting a base oil feed, having a viscosity of greater than 6.5 cSt (measured at 100° C.), a pour point of less than −5° C., and a pour-cloud spread of 15° C. or more, with a solid sorbent at a temperature of less than 66° C. and at a flow rate of less than 10 $hr^{-1}$ WHSV, and producing a dehazed base oil having a cloud point of at least 5° C. lower temperature than that of the base oil feed.

Among other factors, the present invention is based at least in part on the discovery of a haze-free oil with a relatively high cloud point. Conventional dewaxed oils tend to develop a haze on standing at ambient conditions when the cloud point of the dewaxed oil is greater than 0° C., and more readily when the cloud point is greater than 5° C. It has been surprisingly discovered that the haze-forming tendency of a dewaxed oil may be reduced independently of the cloud point, i.e. in the process for producing the base stock of the present invention, the haze-forming tendency, as indicated by the NTU value of the base stock, is more significantly reduced than is the cloud point. Therefore, the present base oil, having a high cloud point, remains haze free, as indicated by its NTU value.

IN THE FIGURES

DETAILED DESCRIPTION

Figure 1:
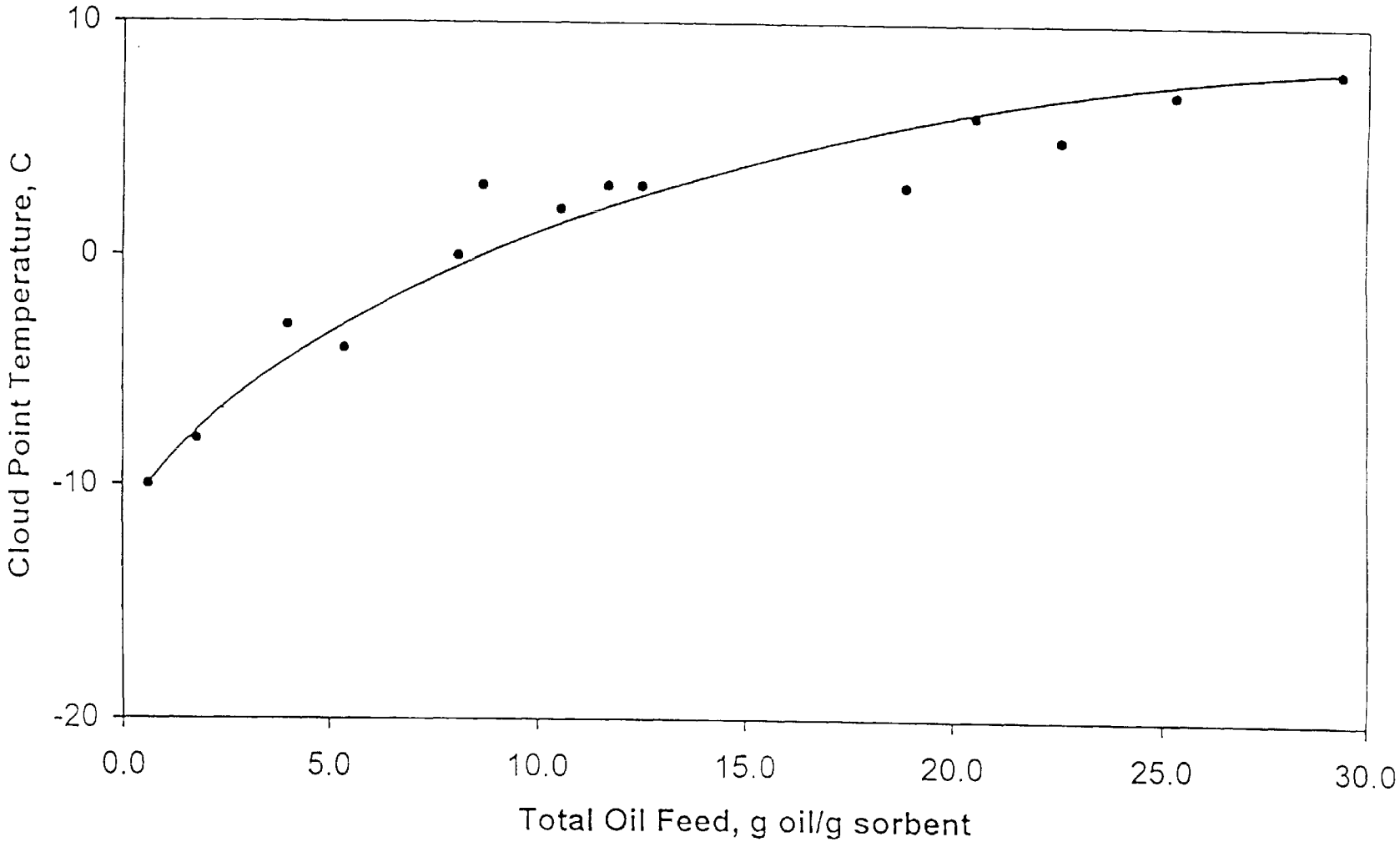
FIG. 1 illustrates the change in the cloud point of a lube base oil product from the sorption step as a function of the time onstream.

In principle, any waxy stock may be dehazed in the sorption process. Because of the relative efficiency of conventional dewaxing processes such as solvent dewaxing and, in particular, catalytic dewaxing, waxy stocks are preferably first dewaxed using one of these conventional methods, with the present process being used to remove the haze precursors remaining after a conventional dewaxing step. The process is most preferably used following a catalytic dewaxing process, since the haze precursors tend to be more abundant in a catalytically dewaxed base oil. The present process is useful for treating streams characterized by a wide range of boiling points. Refinery streams such as diesel feed, waxy middle distillate, lube oils, gas oils and vacuum gas oils, white oils and the like may be treated using the present process. A preferred base oil feed generally boils above about 500° F. (260° C.) and has a viscosity, measured at 100° C., of at least 2.0 cSt. Heavier base oil feeds typically are more prone to developing a hazy appearance on standing. For this reason, feeds having a viscosity greater than 6.5 cSt, measured at 100° C., are ideally suited for the present process.

Exemplary feeds suitable for dewaxing to prepare the feed for use in the process of the invention include waxy distillate stocks such as gas oils, lubricating oil stocks, synthetic oils such as those by Fischer-Tropsch synthesis, high pour point polyalphaolefins, foots oils, synthetic waxes such as normal alphaolefin waxes, slack waxes, deoiled waxes and microcrystalline waxes. Foots oil is prepared by separating oil from the wax. The isolated oil is referred to as foots oil. The feedstock employed in the process of the invention may be a waxy feed which contains greater than about 50% wax, even greater than about 90% wax. Highly paraffinic feeds having high pour points, generally above about 0° C., more usually above about 10° C. are also suitable for use in the process of the invention. Such a feeds can contain greater than about 70% paraffinic carbon, even greater than about 90% paraffinic carbon. The base oil feed may be a vacuum gas oil or deasphalted residua which has been hydrocracked to improve product quality, remove heteroatoms and aromatics and increase viscosity index. The present process is particularly advantageous for removing haze precursors from heavy (i.e. high boiling) stocks such as heavy vacuum gas oils, heavy neutral base oils, bright stock, synthetic oil and the like. Such heavy stocks may be recovered from a mineral oil refining process or from a Fischer Tropsch process. Thus, the boiling point temperature range of the feed to the present process will generally be above about 250° F., preferably above about 500° F., and more preferably above about 850° F.

Bright stock is one preferred feedstock for the present process. Bright stock is derived from a residual oil, optionally via a upgrading step such as solvent deasphalting, and having a boiling point temperature range above about 900° or 925° F., and includes those materials which can only be distilled, without cracking, under a vacuum. Bright stock may also be recovered as a heavy fraction from a hydrocracking process, including hydrocracking a heavy VGO, a residuum, or a heavy synthetic wax such as from a Fischer Tropsch process. A bright stock generally has a viscosity, measured at 100° C., between 20 and 60 cSt, and a viscosity index of greater than about 80, and generally greater than about 90. Bright stocks having a viscosity index of 120 and higher may also be treated in the process.

The feed to the present process is a base oil feed having a low pour point, generally a pour point of less than 0° C., usually a pour point of less than −5° C., or less than −10° C., down to a pour point of −40° C. and below. The feed also has a cloud point which is greater than the pour point of the feed, the cloud point being generally greater than −5° C., often greater than 0° C, or greater than 5° C. or 10° C., or even 20° C., up to as high as 30° C. or higher. In addition, the oil feed has a pour-cloud spread of 10° C. or more, frequently of 15° C. or more, or 20° C. or more, or 30° C. or more, up to 70° C. or more. As used herein, the pour-cloud spread of a sample oil is the difference in temperature between the cloud point and the pour point of the sample oil. For example, a sample oil with a cloud point of 5° C. and a pour point of −5° C. has a 10° C. pour-cloud spread. Thus, the preferred oil supplied as feed to the present process is a catalytically dewaxed base oil having a cloud point greater than −5° C. and usually greater than 0° C., the base oil feed being characterized further by a pour-cloud spread of 10° C. or more. This feed is distinguished from a solvent dewaxed stock, which typically has a pour-cloud spread equal to or near zero.

The lube base oil recovered from the sorption step has a substantially reduced NTU value relative to the cloud point of the lube oil feedstock to the sorption process. While the pour point may also be somewhat reduced during sorption according to the invention, the NTU value is more significantly reduced.

A measure of haze in dehazed product of this invention may be derived from a turbidity test. Turbidity may be measured using a turbidity meter, such as a Hach Co. Model 2100 P Turbidimeter. A turbidity meter is a nephelometer that consists of a light source that illuminates the oil sample and a photoelectric cell that measures the intensity of light scattered at a 90° angle by the particles in the sample. A transmitted light detector also receives light that passes through the sample. The signal output (units in nephelometric turbidity units or NTUs) of the turbidimeter is a ratio of the two detectors. Meters can measure turbidity over a wide range from 0 to 1000 NTUs. The instrument must meet US-EPA design criteria as specified in US-EPA method 180.1. The following table correlates NTU values measured for a number of representative oil samples at 25° C. with the onset of a hazy appearance:

| NTU Value | Appearance |
|---|---|
| 20 | Cloudy |
| 2–5 | Possibly acceptable, but noticeable haze |
| 0.5–2 | Clear and bright |

For purposes of this application, the NTU values were determined at 25° C. unless otherwise indicated.

It has been surprisingly discovered that a base oil having a high cloud point, and/or a high pour-cloud spread may have an acceptable NTU value, such that the haze-forming tendency of the oil is reduced to acceptable levels. Such an oil will have an NTU value of less than 2.

Surprisingly, while the cloud point and NTU value of the feedstocks to the present process are significantly reduced during sorption, the pour point is generally little affected, especially for heavy oils. While reducing the cloud point and NTU values to acceptable levels, the pour point typically decreases by only a few degrees, e.g. 2° C. or less. Only in extreme cases, while treating very high cloud point oils, does the pour point decrease by as much as 5° C. during sorption.

In the process of the invention, the pour-cloud spread may also be reduced in the dehazed oil by at least 5° C. relative to the pour-cloud spread of the base oil feed. However, the cloud point of the dehazed oil product will be higher than that of haze-free conventional oils. Accordingly, the cloud point of the dehazed oil prepared as described herein may be greater than 0° C., even greater than 5° C. In most cases the cloud point will be less than 25° C.

The lube stock which is treated in the sorption process to make the present lubricating oil base stock will usually have been dewaxed in either a solvent dewaxing process or in a catalytic dewaxing process or in a combination of the two processes. Such processes are well known, and do not require extensive discussion here.

Catalytic dewaxing processes have been taught in U.S. Pat. Nos. 4,859,311, 5,246,566, 5,282,958 and 5,376,260. Exemplary catalysts taught for catalytic dewaxing include the zeolites ZSM-5, ZSM-11, ZSM-21, ZSM-22, ZSM-23, ZSM-35, ZSM-38, ZSM-48, ZSM-50, ZSM-57, SSZ-20, SSZ-32, ferrierite and L and other molecular sieve materials based upon aluminum phosphates such as SAPO-11, SAPO-31, SAPO-41, MAPO-11 and MAPO-31.

Dewaxing conditions generally include a temperature which falls within a range from about 200° C. to about 400° C. and a pressure from about 15 to about 3000 psig (0.10–20.7 MPa). More preferably the pressure is from about 100 to about 2500 psig (0.69–17.2 MPa). The liquid hourly space velocity during contacting is generally from about 0.1 to about 20, more preferably from about 0.1 to about 5. The contacting is preferably carried out in the presence of hydrogen. The hydrogen to hydrocarbon ratio preferably falls within a range from about 1.0 to about 50 moles $H_2$ per mole hydrocarbon, more preferably from about 10 to about 30 moles $H_2$ per mole hydrocarbon.

The product of the sorption process may be further treated, such as by hydrofinishing. The hydrofinishing can be conventionally carried out in the presence of a metallic hydrogenation catalyst, for example, platinum on alumina. The hydrofinishing can be carried out at a temperature of from about 190° C. to about 340° C. and a pressure of from about 400 psig to about 3000 psig (2.76–20.7 MPa). Hydrofinishing in this manner is described in, for example, U.S. Pat. No. 5,393,408, which is incorporated herein by reference.

In the embodiment which includes dewaxing and hydrofinishing steps, the sorption process of this invention preferably follows both the dewaxing and hydrofinishing steps. However, under some conditions, the use of a sorption step according to this invention may eliminate the need for a separate hydrofinishing step.

Sorbents useful as sorption media for the sorption process are generally solid particulate matter having high sorptive capacity and with a surface having some acidic character. Sorbents with acid character have a measurable acid site density, determined using well-known infra-red spectroscopic measurements of adsorbed basic molecules such as ammonia, n-butylamine and pyridine. Crystalline molecular sieves (including aluminosilicate zeolites), activated carbon, aluminas, silica-alumina and clays, particularly acid-activated clays, are examples of useful sorbents. A mixture of sorbents or a layered sorbent system may also be used. Manufactured and naturally-occurring aluminas are particularly preferred for the sorption process. Such aluminas include pseudo-boehmite, gamma alumina and alpha alumina. Depending on the application, powders or particles (e.g. extrudates) of alumina may be preferred. For fixed bed applications, alumina extrudates ranging in size from 1/20 inch to 1/8 inch cross sectional diameter are preferred.

Examples of suitable clay sorbents include bauxite, Fuller's earth, attapulgite, montmorillonite, halloysite, sepiolite, and other clays having adsorption properties, whether or not activated with acid. The clay adsorbent used for pretreating the oil is generally in the particle size range of 250–2000 microns. Preferred clays for use in the present process include acid activated clays, generally prepared by treating clay, such as a bentonite clay, with mineral acids to yield a modified clay product of high surface area and acidity and having enhanced adsorptive properties. Acid activated clays are generally described in D. R. Taylor and D. B.Jenkins, Acid-activated Clays, Society of Mining Engineers of AIME (Transactions), vol 282, p. 1901–1910, the entire disclosure of which is incorporated herein by reference. One acid activated clay is a nonswelling bentonite that has been treated with mineral acid to enhance its capacity for adsorbing pigments from oils. A bentonite is a clay ore whose principal mineral in montmorillonite, an end-member of the smectite clay mineral group characterized by a three-layered structure composed of two silica sheets sandwiches about a central alumina sheet. A typical, non-limiting, formula of montmorillonite is:

$$Si_8(Al_{3.34}Mg_{0.66})O_{20}(OH)_4 \cdot 0.66Na$$

Crystalline molecular sieve materials also may be used in a adsorption bed for removing the haze precursors from the base oil feed. Any zeolite having surface acidity, such as zeolites Y, USY, X, A, beta, L, ZSM-5, SSZ-32 and the like may be used. Other molecular sieves include crystalline aluminophosphates such as AlPO-11, crystalline silicoaluminophosphates such as SAPO-11 and the like. Molecular sieve adsorbents may be granular or as shaped particles of a suitable size, usually smaller than 1 cm effective diameter.

In the sorption process, contacting can be performed in batch mode, e.g., a volume of sorbent is added, preferably with stirring, to a volume of oil, permitted to stand, then the oil is drained or filtered and a new oil charge is added.

Alternatively contacting can be performed under continuous conditions using a fixed bed, moving bed, slurry bed, simulated moving bed or magnetically stabilized fluidized bed and employing either upflow, downflow or radial flow continuous oil circulation.

During the sorption process using downflow oil circulation, the oil is allowed to pass downward through a sorbent bed, packed with one or more clays or other sorbents useful for reducing the cloud point of the base oil feed. The sorption process is preferably run at temperatures below 66° C. and more preferably at a temperature in the range between about 10° C. and about 50° C., and at a oil flow rate of up to 10 $hr^{-1}$ weight hourly space velocity (WHSV), more preferably at a oil flow rate in the range of 0.01 to 10 $hr^{-1}$, most preferably in the range of 0.1 to 5 $hr^{-1}$, still more preferably in the range of 0.25 to 2.5 $hr^{-1}$. The rate at which the haze precursors are adsorbed is improved by lowering the adsorption temperature. Ambient pressures or above are generally preferred. It will be immediately obvious to the skilled practitioner that the temperature for removing the haze in the present process is much less than the temperatures used in commercial operations for reducing color from oil using a solid sorption process.

Figure 4:
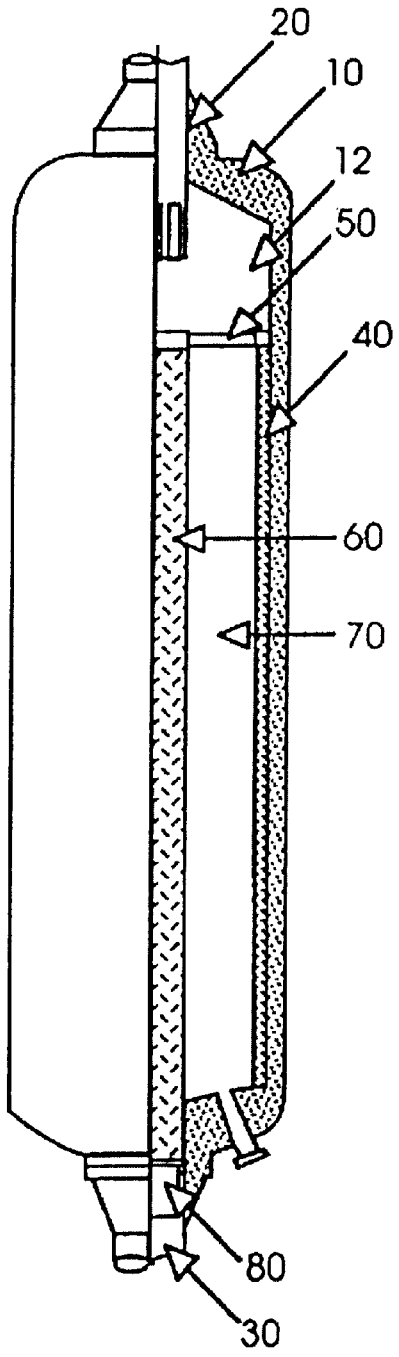
FIG. 4 is a block diagram of a preferred vessel for use in the process of the invention.

Referring to FIG. 4, which shows a half cutaway view of a side elevation of one embodiment of a vessel useful for contacting the oil with a sorbent in radial flow according to the present sorption process, the vessel has a shell 10 having an internal cavity 12. Towards the top of the shell, an inlet means 20 is connected to internal cavity 12 to afford passage of material into the cavity. Within the bottom of the vessel shell 10 is an outlet means 30. That outlet means 30 is connected to internal cavity 12 to afford passage of material out of the cavity.

Within internal cavity 12 is a porous support means 40 that lines a lower portion of the internal surface of shell 10. Porous support means 40 helps to support the sorbent bed within annulus 70, and further permits the flow of fluid into the sorbent bed. Porous support means 40 may be in the form of scallops, or vertical tubes lining the internal surface of shell 10, or a concentric porous column lining the internal surface of shell 10 and providing a cavity space between the internal surface of shell 10 and porous support means 40. Also within internal cavity 12 is a cover means 50 that rests upon the top of porous support means 40.

A porous, vertical, hollow centerpipe 60 fits within internal cavity 12, and below cover means 50, to form an annulus 70 between porous support means 40 and centerpipe 60. The bottom of centerpipe 60 rests on a ledge within outlet means 30 to block access of flow of solids from annulus 70.

In a sorption vessel, the annulus would contain sorbent. The material flowing into the cavity would be oil having a tendency to form haze. That material flows downward, past the cover means and through the porous support means into the annulus, where it contacts the sorbent. The dehazed product flows through the porous centerpipe and out through the outlet means.

A blocking sleeve 80 is within vessel shell 10 for preventing the flow of solids from annulus 70 to outlet means 30.

The sorption process is also described in copending commonly owned U.S. Application entitled "Sorbent Treating of Lubricating Oils to Remove Haze Precursors", filed Jun. 8, 2000, the entire disclosure of which is incorporated herein by reference for all purposes.

The oil feed to the process may be added to the sorbent bed with or without dilution. In some cases, it may be preferred to cut the high viscosity of the oil feed with a light solvent, which is then removed following sorption. A suitable solvent will dissolve the oil feed, and will remain a liquid (minimal volatilization) during the sorption process. Regardless of whether a solvent is used, the sorption process will continue until the cloud point or NTU value of the treated oil product increases above a predetermined maximum, indicating that the adsorbent has become saturated. The sorbent then may be regenerated or replaced. As a rule, the quantity of oil pretreated by the solid adsorbent according to the present process lies between 1,000 gallons of oil per ton of sorbent to about 80,000 gallons of oil per ton of adsorbent, preferably between 2,000 and 40,000 gallons per ton, before the sorbent must be regenerated or replaced.

At the start of a sorption process, using fresh or freshly regenerated sorbent, the sorbent will absorb an amount of oil until saturated. Indeed, the sorbent bed may swell during the first period of the sorption process as a result of oil sorption. At steady state operation, with the sorbent saturated with oil, yields of lube stock having the haze precursors removed in the sorption process are generally greater than 95%, often greater than about 98%, up to 100% yield based on base oil feed to the sorption process.

Sorbent which has become saturated with adsorbed haze precursors may be regenerated by heating to a temperature above the adsorption temperature and sweeping the sorbent with a fluid to remove the haze precursors. Gaseous and/or liquid sweep fluids may be used. A preferred regeneration method includes heating the sorbent containing sorbed haze precursors at a temperature of about 66° C. or higher, preferably between 66° C. and 120° C., passing the base oil feed through the sorbent to remove adsorbed haze precursors, and withdrawing a stream containing a high amount of haze precursors for reaction in other refinery processes. Both polar and non-polar solvents may also be used to remove adsorbed haze precursors at temperatures above and below 66° C., including paraffins such as hexane, aromatics such as benzene, toluene and xylene, and polars such as methyl ethyl ketone, and refinery streams such as diesel or light lubes.

In a non-limiting example, the present process for producing an improved base oil with a reduced tendency to form a haze after standing at ambient temperatures, comprises contacting a base oil feed having a viscosity of greater than 6.5 cSt (measured at 100° C.), a pour point of less than −5° C., and a pour-cloud spread of greater than 15° C., with a solid sorbent at a temperature of less than 66° C. and at a flow rate of less than 10 $hr^{-1}$ WHSV and producing a dehazed base oil having a reduced pour-cloud spread relative to that of the dehazed base oil. In a preferred embodiment, the base oil feed is contacted with a sorbent, preferably an alumina or clay sorbent, and more preferably an alumina sorbent, at a temperature of less than 66° C., preferably between 10° and 50° C. (e.g. 27° C.) for between 15 minutes and 2 hours. In a separate preferred embodiment, the base oil feed has an NTU value of greater than 2.0 and, more preferably, the dehazed base oil has an NTU value of less than 2.0. In the most preferred embodiment, the dehazed oil leaving the process will have a pour point of less than −9° C., a cloud point of less than 0° C. and an NTU value of less than 2.0.

The following examples are presented as illustrating preferred embodiments of this invention and are not intended as undue limitations on the generally broad scope of the invention as set out in the appended claims.

EXAMPLES

Example 1

A sample of Tonsil CO 630G, (an acid activated calcium bentonite from Süd-Chemie Indonesia) having the properties shown in Table I, was dried at 120° C. and contacted with hazy bright stock having a pour point of −14° C. and a cloud point of 13° C. After passing the bright stock sample through the Tonsil CO 630G clay bed at 110° F., the resultant oil had a pour point of −26° C. and a cloud point of −5° C. The test was repeated using bauxite as the adsorbent. The resultant oil had a pour point of −-22° C. and a cloud point of 5° C.

TABLE I

| | |
|---|---|
| Bulk density, g/l | 500–600 |
| Free moisture (2 h, 110° C.), % max | <6% |
| Loss on ignition (2 h, 1000° C.), % max | <10% |
| pH (10% suspension, filtered) | 2.4–3.0 |
| Free Acidity, mg KOH/g | 2.7–3.3 |
| Total Acidity, mg KOH/g | 9.0–12.0 |
| Surface area, $m^2/g$ | 230–250 m |
| Micropore volume (0–80 nm), ml/g | 0.30–0.35 |
| Particle size | >90 wt % through 20 mesh (850 μm) <10% through 60 mesh (250 μm) |

Example 2

Tonsil CO 630G was tested using a bright stock sample (Table II) with a cloud point of 12° C. and a pour point of −21° C. The bright stock was passed over a 13.8 gram sample of Tonsil CO 630G at a feed rate of nominally 0.065 $hr^{-1}$ WHSV, a temperature of 28° C. (82° F.) and at a positive pressure above ambient of between 20.7 KPa (3 psig) and 96 KPa (14 psig). The effectiveness of this acid-activated clay for removing the haze precursors is seen in FIG. 1, which illustrates the change in the cloud point of the lube base oil product from the sorption step as a function of the time onstream. The initial cloud point of the product was −10° C., and the clay continued to remove haze precursors until the clay had treated 30 grams oil per gram sorbent.

TABLE II

| Bright Stock Properties | |
|---|---|
| VI | 115 |
| vis @ 100° C. | 27.13 cSt |
| vis @ 40° C. | 314.6 cSt |
| Pour Point | −21° C. |
| Cloud Point | +12° C. |
| Weight % Aromatics | 0.2592 |

Example 3

Tonsil CO 630G and a Pural alumina were tested for dehazing a dewaxed commercial Fischer-Tropsch wax sample obtained from Moore and Munger, N.Y. Inspections of the dewaxed sample are given in Table III. The sample had a cloud point of +29° C. and a pour point of −51 ° C. After passing through Tonsil CO 630G at a WHSV of 1 $hr^{-1}$, the cloud point of the sample dropped to −8° C.; when passed through the alumina at 3.6 $hr^{-1}$, the cloud dropped to −20° C.

TABLE III

| Dewaxed Fischer-Tropsch Wax Sample | | |
|---|---|---|
| Vis @ 100° C. | 9.238 cSt | |
| Vis @ 40° C. | 57.99 cSt | |
| VI | 140 | |
| Density | 0.083 g/cm$^3$ | |
| Pour Point | 51° C. | |
| Cloud Point | +29° C. | |
| SimDist TBP (Wt %) | ° F. | ° C. |
| 0.5/5 | 692/716 | 367/380 |
| 10/30 | 738/828 | 392/442 |
| 50 | 918 | 492 |
| 70/90 | 1015/1158 | 546/656 |
| 95/99.5 | 1214/1312 | 657/711 |

Example 4

Example 3 was repeated with dewaxed heavy neutral base oil using Pural alumina. Results are shown in Table IV. The results show a significant decrease in the cloud point, even at very high oil flow rate.

TABLE IV

| Dewaxing Heavy Neutral Base Oil | | |
|---|---|---|
| Feed Properties | | |
| Cloud Point, ° C. | | 11 |
| Pour Point, ° C. | | −11 |
| Test No. | IV-A | IV-B |
| Oil Flow Rate (WHSV), $hr^{-1}$ | 3.2 | 3.75 |

TABLE IV-continued

| Dewaxing Heavy Neutral Base Oil | | |
|---|---|---|
| Product Properties | | |
| Product Cloud Point, ° C. | −5 | −1 |
| SimDist TBP (Wt %) | ° C. | ° C. |
| 0.5/5 | 363/423 | 364/420 |
| 10/30 | 446/486 | 443/486 |
| 50 | 509 | 509 |
| 70/90 | 533/564 | 532/563 |
| 95/99 | 579/624 | 578/614 |

Example 5

Figure 2:
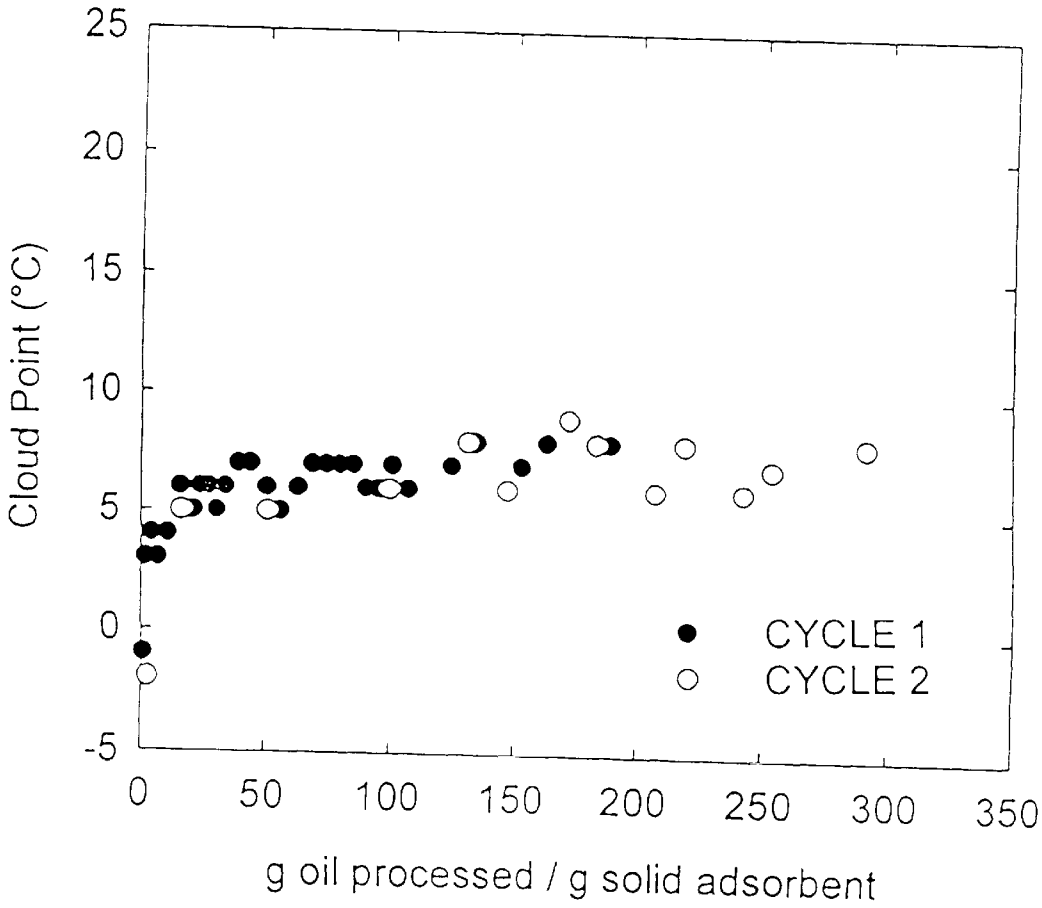
FIG. 2 illustrates the cloud point reduction of a hazy bright stock which is passed through a pseudo-boehmite alumina adsorbent.

The lifetime of pseudo-boehmite alumina adsorbent was tested using dewaxed bright stock having a pour point of −25° C. and a cloud point of +23° C. (FIG. 2). The temperature of the adsorbent bed (27° C.) and feed rate of the dewaxed oil (1.3–1.5 $hr^{-1}$ WHSV) were held constant during the experiment. The alumina adsorbent reduced the cloud point of the dewaxed oil to about +8° C. while treating more than 175 grams of oil per gram of alumina adsorbent (FIG. 2). The alumina was then regenerated by heating the adsorbent bed to 66 ° C. and passing a hexane solvent over the alumina. After regeneration, the alumina bed was cooled to 27° C. and the hazy dewaxed bright stock again passed over the alumina. During the second cycle, the alumina reduced the cloud point of the dewaxed oil to +8° C. while treating an additional 300 grams of oil per gram of alumina adsorbent at a feed rate of 1.4 to 2.0 $hr^{-1}$ WHSV.

Example 6

Figure 3:
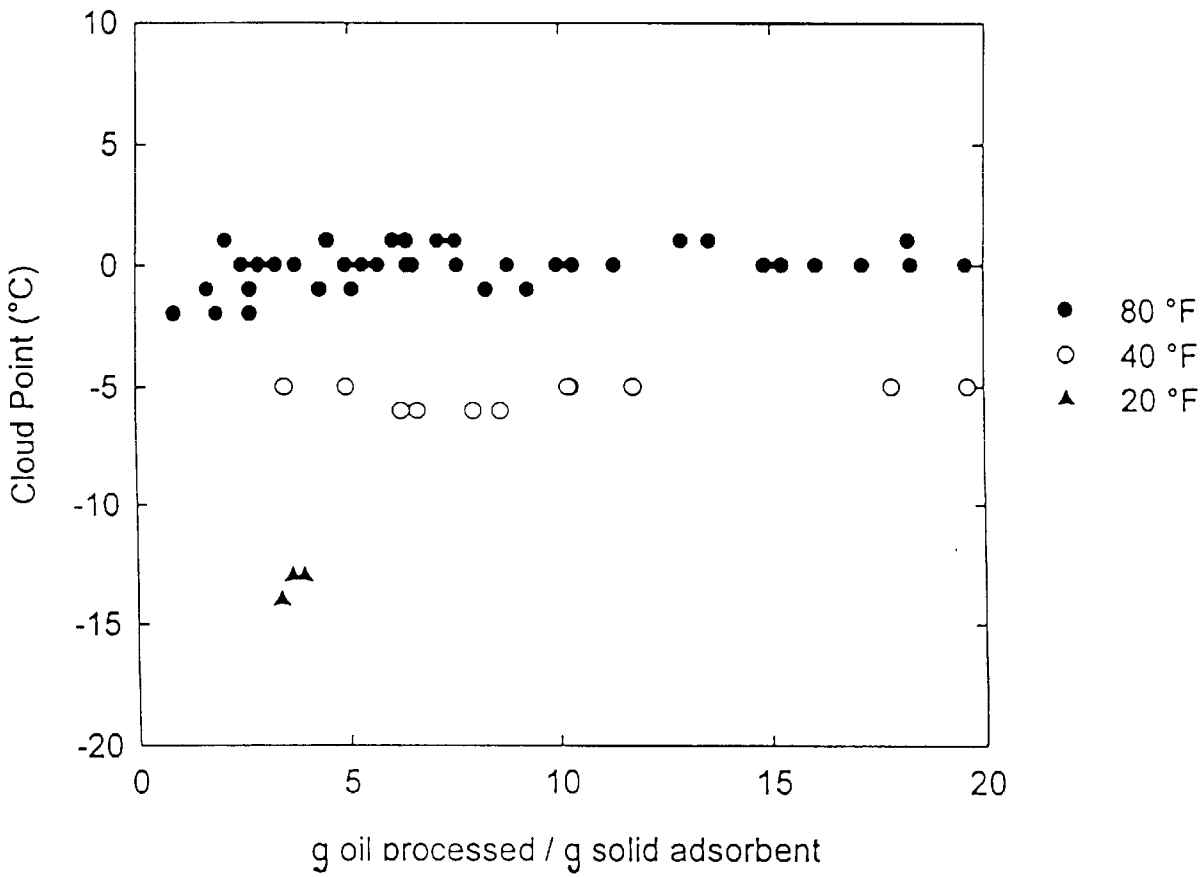
FIG. 3 illustrates the cloud point reduction of a hazy heavy neutral base oil which is passed through a pseudo-boehmite alumina adsorbent.

A heavy neutral base oil having a viscosity of 8 cSt, measured at 100° C., and a cloud point of +5° C. was treated through a bed of pseudo-boehmite sorbent at 27° C. and at feed rates (WHSV) varying from 0.05 $hr^{-1}$ to 1.0 $hr^{-1}$. The data in FIG. 3 shows that the treated oil product had a cloud point of about 0° C. through the entire test, with no observable effect of varying feed rate of sorption rate for this sample.

The sorption temperature was then reduced to 4° C., and the heavy neutral base oil treated through the pseudo-boehmite sorbent at feed rates varying from 0.1 $hr^{-1}$ to 1.8 $hr^{-1}$. The treated oil product had a cloud point of about −5° C. through the entire test, again with no observable effect of varying feed rate of sorption rate for this sample.

The sorption temperature was then reduced to −7° C., and the heavy neutral base oil treated through the pseudo-boehmite sorbent at a feed rate of 0.2 $hr^{-1}$. The treated oil product had a pour point of about −13° C. The data shows that the performance of the alumina sorbent for reducing cloud point of the 8 cSt oil improved with decreasing temperature. However, varying the feed rate had no measurable effect on cloud point reduction in this test.

Example 7

A dewaxed bright stock with a hazy appearance was treated through a bed of pseudo-boehmite adsorbent at 75° F. and at a feed rate of 1.3–1.7 $hr^{-1}$ WHSV. The properties of the hezy dewaxed bright stock and the base oil recovered from the sorption process are shown in Table VI. In the sorption process the cloud point was substantially reduced and the clarity substantially improved, while pour point, color, VI and viscosity were scarcely changed at the selected sorption conditions.

TABLE V

| | Dewaxed base oil | Dewaxed base oil after alumina adsorption |
|---|---|---|
| Point Point (° C.) | −24 | −26 |
| Cloud Point (° C.) | +17 | +5 |
| Clarity (NTU) | 5.1 | 2.6 |
| Color (ASTM 1500) | L1.0 | L1.0 |
| VI | 113 | 113 |
| Viscosity at 40° F. (cSt) | 328.8 | 239.7 |
| Viscosity at 100° F. (cSt) | 27.6 | 27.7 |

Example 8

Different adsorbent materials were evaluated for their ability to remove haze precursors from a catalytic dewaxed petroleum-derived bright stock having a cloud point of +14° C., pour point of −14° C., and haze appearance (clarity) as measured by a Hach Turbidimeter (Model 2100P at 25° C.). Dewaxed bright stock was passed over a solid adsorbent at 80° F. Alumina has superior haze removing and cloud point reducing properties (Table VI). Some materials (e.g. silica) can also improve appearance and reduce haze without significantly lowering the cloud point, suggesting that haze removal and cloud point reduction are not directly related. Similarly, the haze appearance of dewaxed base oil can be altered without affecting the cloud point reducing capabilities of the adsorbent (Table VII).

TABLE VI

Cloud reduction and haze removal properties of various adsorbent materials at 80° F.

| Material | Space Velocity (WHSV, $hr^{-1}$) | Cloud Point (° C.) of Oil | Clarity NTU |
|---|---|---|---|
| Feed Material | | 14 | 10.70 |
| After adsorption using: | | | |
| Harshaw Pural Alumina | 0.51 | −11 | 0.17 |
| Silica | 0.03 | 7 | 0.18 |
| Na-ZSM5 | 0.15 | 9 | 0.35 |
| 13X Zeolite | 0.04 | 8 | 1.24 |

While the cloud point decreased somewhat, the pour point was not significantly affected when the haze was removed. All four treated lube base oils had NTU values below 2.0 and were judged to be clear and bright.

TABLE VII

Cloud reduction and haze removal properties of various aluminas at 80° F.

| Material | Space Velocity (WHSV, $hr^{-1}$) | Cloud Point (° C.) of Oil | Clarity NTU |
|---|---|---|---|
| Feed Material | | 14 | 10.70 |
| After adsorption using: | | | |
| Harshaw Pural Alumina | 0.51 | −11 | 0.17 |
| Dehydrated Harshaw Pural Alumina | 0.49 | −11 | 0.58 |

Example 9

The effect of cloud point, haze, color, and pour point during base oil adsorption was examined as a function of time on stream. Dewaxed petroleum-derived bright stock was processed at 80° F. in a plug flow reactor loaded with pseudo-boehmite alumina. The dewaxed bright stock had a cloud point of +18 ° C., pour point of −25° C., saybolt color of 6.2, and haze appearance (clarity) as measured by a Hach Turbidimeter (Model 2100P) of 1.23 NTU. After 10,000 gallons of oil per ton alumina was processed, the cloud point of the dewaxed oil was reduced from +18° C. to +5° C., NTU from 1.23 to 0.24, and Saybolt color from 6.2 to 27.8 (Table VIII). After 25,000 gallons of oil processed, the ability of the alumina to remove color bodies and haze started to diminish as the saybolt color reduced from 27.8 to 20.0 and NTU decreased from 0.24 to 0.41, without any change in cloud point. These different rates of deactivation suggest that color removal, haze removal (clarity), and cloud point are caused by different species.

TABLE VIII

Effect of dewaxed base oil cloud point, haze (clarity), saybolt color, and pour point as function of time on-stream during alumina adsorption at 80° F.

| Time on Stream | Cloud Point (° C.) | Clarity NTU | Saybolt Color | Pour Point (° C.) |
|---|---|---|---|---|
| Before adsorption | +18 | 1.23 | 6.2 | −25 |
| 10,000 gal oil processed/ton alumina | +5 | 0.24 | 27.8 | −26 |
| 25,000 gal oil processed/ton alumina | +5 | 0.41 | 20.0 | −26 |
| 35,000 gal oil processed/ton alumina | +7 | 0.41 | 18.9 | −26 |
| 50,000 gal oil processed/ton alumina | +7 | 0.46 | 17.1 | −26 |

This example shows the substantial improvement in turbidity, small improvement in cloud point, and lack of improvement in the pour point. All four treated samples had NTU values below 1.0 and were judged to be clear and bright.

Example 10

Experimental bright stocks derived from FT wax were examined for pour point, cloud point, haze (NTU) and clarity (visual inspection) (Table IX). References to commercial 30 cSt PAO made by the expensive ethylene oligomerization route is also provided.

TABLE IX

Base oil properties before and after adsorption dehazing.

| Stock | Pour Point, ° C. | Cloud Point, ° C. | NTU | Appearance |
|---|---|---|---|---|
| 30 cSt PAO | −42 | — | 0.34 | Clear and bright |
| 25 cSt FT-base oil | −12 | +29 | 20.10 | Cloudy |
| 25 cSt FT-base oil after dehazing | −12 | +20 | 2.34 | Slightly hazy |
| 25 cSt FT-base oil after dehazing | ~−12 | +10 | ~<1.0 | Clear and bright |
| 8 cSt FT-base oil after dehazing | −15 | +5 | 0.78 | Clear and bright |
| 8 cSt FT-base oil after dehazing | −15 | −13 | 0.32 | Clear and bright |
| 8 cSt FT-base oil after dehazing | −15 | −5 | 0.16 | Clear and bright |

Since the turbidity test most closely simulates the environment in which the lube base oil is examined by the customer to determine acceptability, it is a more reliable measure than the cloud point. In addition, oils which have cloud points greater than −10° C., and less than the temperature of inspection (i.e. ambient temperature, such as 25° C.) and NTU's below 2.0 are acceptable.

What is claimed is:

1. A lubricating oil base stock having a reduced tendency to form a haze after standing at ambient temperatures, the base stock characterized by:

a) a pour point of less than −5° C.;

b) a cloud point greater than 0° C.;

c) an NTU value of less than 2.0.

2. The lubricating oil base stock according to claim 1 having a cloud point greater than 5° C.

3. The lubricating oil base stock according to claim 2 wherein the lubricating oil base stock has a cloud point of less than 25° C.

4. The lubricating oil base stock according to claim 1 having a viscosity of greater than 6.5 cSt (measured at 100° C.).

5. The lubricating oil base stock according to claim 1 which boils in the range 650–750° F.+.

6. The lubricating oil base stock according to claim 1 having a pour-cloud spread of 10° C. or more.

7. The lubricating oil base stock according to claim 1 having a cloud point greater than −10° C. and less than ambient temperature.

8. The lubricating oil base stock of claim 1 which is derived from a Fischer-Tropsch process.

9. The lubricating oil base stock of claim 1 prepared by:

a) contacting a 650°–750° F.+paraffinic stream derived from a Fischer-Tropsch process with a dewaxing catalyst at a temperature in the range 500–800° F. and a pressure in the range 100–3000 psig and producing a dewaxed oil having an NTU value greater than 2.0, and;

b) contacting at least a portion of the dewaxed oil with a solid sorbent and producing a lubricating oil base stock having a pour point of less than −5° C., a cloud point greater than 0° C. and an NTU value of less than 2.0.

10. The lubricating oil base stock according to claim 9 having a cloud point greater than 5° C.

11. The lubricating oil base stock according to claim 10 wherein the lubricating oil base stock has a cloud point of less than 25° C.

12. The lubricating oil base stock according to claim 9 having a viscosity of greater than 6.5 cSt (measured at 100° C.).

13. The lubricating oil base stock according to claim 9 which boils in the range 650–750° F.+.

14. The lubricating oil base stock according to claim 9 having a pour-cloud spread of 10° C. or more.

15. The lubricating oil base stock according to claim 9 having a cloud point greater than −10° C. and less than 25° C.

16. The lubricating oil base stock of claim 9 which is derived from a Fischer-Tropsch process.

* * * * *